US005109892A

United States Patent [19]

Somers

[11] Patent Number: 5,109,892

[45] Date of Patent: May 5, 1992

[54] PROCESS FOR PACKAGING AMORPHOUS POLYOLEFINS

[75] Inventor: Marc S. Somers, Longview, Tex.

[73] Assignee: Eastman Kodak Company, Rochester, N.Y.

[21] Appl. No.: 634,985

[22] Filed: Dec. 27, 1990

[51] Int. Cl.[5] ..... B65B 3/04

[52] U.S. Cl. ..... 141/11; 53/440; 141/1

[58] Field of Search ..... 53/127, 440, 452; 141/1, 11, 69, 82

[56] References Cited

U.S. PATENT DOCUMENTS

| | | | |
|---|---|---|---|
| 1,607,626 | 11/1926 | Hopkinson | 53/452 |
| 3,564,808 | 2/1971 | Kent | 53/440 |
| 3,923,758 | 12/1975 | Carter, Jr. et al. | 526/152 |
| 3,954,697 | 5/1976 | McConnell et al. | 526/90 |
| 4,093,485 | 6/1978 | Ornsteen | 156/244.13 |
| 4,137,692 | 2/1979 | Levy | 53/440 |
| 4,306,657 | 12/1981 | Levy | 206/447 |
| 4,335,560 | 6/1982 | Robinson | 53/440 |
| 4,450,962 | 5/1984 | Matthews et al. | 206/447 |
| 4,627,224 | 12/1986 | Hamamoto et al. | 53/502 |

FOREIGN PATENT DOCUMENTS

| | | | |
|---|---|---|---|
| 2161990 | 1/1971 | Fed. Rep. of Germany . | |
| 2721445 | 11/1978 | Fed. Rep. of Germany | 53/440 |
| 3113805 | 10/1982 | Fed. Rep. of Germany . | |
| 2544654 | 10/1984 | France . | |
| 0776947 | 1/1980 | U.S.S.R. | 141/1 |
| 0935357 | 8/1963 | United Kingdom | 53/440 |
| 1402005 | 8/1975 | United Kingdom . | |
| 1448246 | 9/1976 | United Kingdom . | |

*Primary Examiner*—William A. Cuchlinski, Jr.
*Assistant Examiner*—W. Morris Worth
*Attorney, Agent, or Firm*—Mark A. Montgomery; William P. Heath, Jr.

[57] ABSTRACT

A process for packaging normally tacky amorphous polyolefins is provided. The process entails flowing a heated amorphous polyolefin into a molded polyolefin container having a relatively thick wall at a temperature above the melting point of the container, followed by slowly cooling the filled container.

16 Claims, No Drawings

PROCESS FOR PACKAGING AMORPHOUS POLYOLEFINS

FIELD OF THE INVENTION

The present invention relates to a process for packaging amorphous polyolefins. The process of the present invention more particularly relates to a process of packaging amorphous polyolefins into a rigid polyolefin container that is melt blended with the amorphous polyolefin in its end use.

BACKGROUND OF THE INVENTION

Amorphous polyolefins are well known and are very useful in adhesives, roofing compositions, cable filling, cable flooding, and caulk and sealants. Amorphous polyolefins are produced and then transferred or shipped in many different forms for incorporation into final compositions. Amorphous polyolefins are generally tacky at room temperature and have a low degree of crystallinity and therefore are not easily formed into powders or pellets for shipment. Amorphous polyolefins are generally transferred in the molten state in large containers, as small slats coated with a non-tacky substance packaged in corrugated containers, or small and large blocks packaged in a release coated paper container.

The most preferred form to transfer amorphous polyolefins is in the bulk molten form. The bulk molten form is preferred due to its low processing cost. However, the bulk molten form is shipped in large containers such as tank cars and many end users do not have the capability to unload or store these large quantities of molten amorphous polyolefins. Therefore, many end users prefer amorphous polyolefin packaged in an economical and easy to use solid form.

Compounders or end users of the amorphous polyolefin prefer forms of the solid amorphous polyolefin that are easy to handle. Amorphous polyolefin pellets would be most desirable, however, their production is very difficult and they are not commercially available. Thus, of the available forms, amorphous polyolefin slats are generally the form most preferred and easiest to handle. However, slats are expensive to manufacture and thus increase the raw material cost to the end user.

In light of the above, the form most economical to use is the amorphous polyolefin in solid blocks. However, the use of the solid block form of amorphous polyolefin is very labor intensive, requiring the end user to remove the coated paper prior to blending. The paper is often adhered to the APO and difficult to remove and also generates solid waste. The larger solid form i.e. 50 pound package is generally preferred over the 20 pound package due to the reduced time spent to remove the package from around the block per any given amount of amorphous polyolefin. A solid form that is cheap yet does not require the labor to unwrap would be very desirable for the end users.

It is known to enclose slabs of material in a film that is later incorporated into the composition without being unwrapped such as disclosed in FR 2,608,560 and DE 1,511,577. However, these process involve elaborate filling and cooling steps.

In light of the above, it would be very desirable to be able to cheaply produce amorphous polyolefins in a solid form that could be easily incorporated or blended with other materials to reduce the cost of the final composition.

SUMMARY OF THE INVENTION

The process for packaging amorphous polyolefins comprises:

(A) supplying an amorphous polyolefin at a flowable temperature, (B) flowing said amorphous polyolefin into a molded polyolefin container having a wall thickness at least 10 mils wherein the material of said container has a melting point below the temperature at which said amorphous polyolefin is flowed into the container, and (C) cooling the filled container.

DETAILED DESCRIPTION OF THE INVENTION

The applicant has unexpectedly discovered that an amorphous polyolefin can be flowed into a rigid container at a temperature above the melting point of the container without the need of an elaborate cooling of the outside surface of the filled container.

The amorphous polyolefins packaged according to the process of the present invention are normally soft and tacky at about room temperature, solidify slowly and have a low degree of crystallinity. These tacky amorphous polyolefins are not easily pelletized or packaged by conventional processes. The amorphous polyolefins include for example amorphous poly-alpha-olefins, amorphous copolymers and amorphous terpolymers. The more preferred amorphous polyolefins are amorphous polypropylenes, and amorphous copolymers of propylene and at least one other alpha olefin such as ethylene, 1-butene and 1-hexene. These amorphous polyolefins preferably have a Ring and Ball Softening Point (RBSP) between about 80° C. and 160° C., and a Brookfield Thermosel Viscosity between about 200 and 25,000 centipoise (cP) at 190° C. These amorphous polyolefins more preferably have a RBSP between about 120 and 160 and a Brookfield Thermosel Viscosity between about 2,000 and 20,000 cP at 190° C. Such soft and tacky amorphous polyolefins are known in the art and are disclosed in U.S. Pat. No. 3,954,697 and U.S. Pat. No. 3,923,758, the disclosures of which are incorporated herein by reference in their entirety.

The molded polyolefin container is preferably prepared from polyolefins that are compatible with asphalt blends. These polyolefin materials are preferably selected from the group consisting of polypropylene homopolymers, ethylene-propylene random copolymers, impact copolymers, filled polypropylenes, and polypropylene blended with another compatible polymer such as polypropylene-polyethylene blends.

The molded polyolefin container is a rigid freestanding container, preferably a cylindrical container such as a bucket. The molded polyolefin container has a wall thickness of at least about 0.01 inches (10 mils or about 0.25 mm). The wall thickness of the molded polyolefin container is preferably between about 10 and 150 mils (between about 0.25 and 4 mm). The molded polyolefin container more preferably has a wall thickness between about 30 and 125 mils (between about 0.75 and 3.2 mm). The molded polyolefin container preferably has an outer diameter or width between about 4 and 15 inches (between about 10 and 38 cm) having a volume between about 1 and 10 gallons (between about 4and 38 liters). The molded polyolefin container more preferably has an outer diameter between about 8 and 13inches (between about 20 and 33 cm) and a volume of about 8 to 9 gallons (about 30 to 34 liters). The molded polyolefin container preferably has an internal diameter or internal width between about 4 inches and 12inches (about 10 and 30 cm).

The molded polyolefin container used in the present invention is made of a material that has a melting point that is below the fill temperature or temperature at which the amorphous polyolefin is flowed into the container. However, the molded polyolefin container preferably has a melting point that is no more than about 50° C. below the fill temperature. This melting point is more preferably no more than about 40° C. below the fill temperature. The molten polyolefin container preferably has a $\Delta T$ across the container wall between about 0.5° C. and 0.9° C. per mil (0.025 mm) at room temperature when filled. The fill temperature is preferably between about 150° C. and 230° C., more preferably between about 190° C. and 200° C.

The amorphous polyolefin is generally heated or maintained at an elevated temperature in a heated vessel prior to being flowed into the molded polyolefin container. This vessel is preferably a heated storage container and the amorphous polyolefin is heated during the polymerization reaction and is transferred to heated storage containers.

It is preferred that the molten, or flowable amorphous polyolefin is flowed into a plurality of containers. The rate at which these molded polyolefin containers are filled with the flowable amorphous polyolefin is between about 1 and 300 pounds per minute per container (between about 1 and 140 kg per minute) more preferably between about 8 and 20 pounds per minute (between about 4 and 9 kilograms per minute) per container.

Once the molded polyolefin container is filled with the flowable or molten amorphous polyolefin the container is allowed to cool slowly, essentially at ambient conditions and some form of elaborate cooling such as cold water bath is not required. When the filled molded polyolefin container is allowed to cool at ambient conditions, the container should not have any significant contact with other containers (except at the lip) containing hot amorphous polyolefin for about 8 to 24 hours. In other words, the filled containers should not be stacked until the amorphous polyolefin has cooled. These containers are more preferably isolated from significant contact with these other containers for at least about 12 hours. This time period can be significantly reduced if the outside surface of the container is cooled by flowing a fluid such as water or air around the container. If air is used as the cooling fluid, the preferred temperature is between about −20° C. to about 50° C. with a temperature between about 0° C. and 40° C. being more preferred. If water is used as the cooling fluid, such as a mist or spray, the preferred temperature of this water is between about 0° C. and 40° C.

The molten amorphous polyolefin in the molded polyolefin container is preferably cooled as fast as possible without resorting to complicated cooling means. The cooling rate is preferable at about 0.05° C. to 0.45° C. per minute, based on core temperature, down to a core temperature of about 100° C. or below.

The flowable temperature at which the amorphous polyolefin is flowed into the molded polyolefin container is preferably less than about Y° C., wherein Y=8.54 times the melting point of the container material (Tm) in degrees celsius times the minimum wall thickness of the container in inches plus 143 according to the formula below:

$$Y = 8.54 * Tm.\ ^\circ C. * \text{minimum wall thickness, inches} + 143$$

or where container wall thickness is measured in millimeters (mm):

$$Y = 0.34 * Tm.\ ^\circ C. * \text{minimum wall thickness, mm} + 143$$

This relationship generally represents a temperature below which the container or bucket will not melt and is generally linear.

The use of a lid for these molded polyolefin containers is not required; however, should one be used it is preferred to wait until the container has cooled significantly prior to attaching the lid. However, if the container is cooled with water a lid or cover is generally required prior to cooling.

The preferred type of fill apparatus generally includes conventional quick opening valves that are manually, mechanically, or hydraulically controlled and include for example ball and butterfly valves.

The molten amorphous polyolefin cools as it flows towards the wall of the container. The hottest point of the filled container is in the center of the molten amorphous polyolefin. The molten amorphous polyolefin resting against the inside wall of the container is generally at a temperature higher than the melting point of the polypropylene material but does not melt the polypropylene material since there is a temperature gradient across the container wall. However, should the outside wall of the container reach the melting temperature the container will deform and melt. Thus, care must be taken to avoid significant contact with other hot containers. Also, the container should not be overfilled since hot-molten amorphous polyolefin flowing down the outside of the container would significantly decrease the temperature gradient across the container wall, allowing the outside of the container to reach the melting point, thereby melting the container.

The following examples illustrate the present invention and are not intended to limit the reasonable scope thereof.

EXAMPLES

Example 1

Several injection molded PP containers were filled with a molten amorphous propylene-ethylene (APE) copolymer at temperatures between 190° C. and 205° C. and are illustrated in Table 1 below. This APE has a viscosity at 190° C. of 5,800 centipoise (cP) and a typical specific heat value (Cp) of 0.67 calories/gram ° C. between 175° C. and 185° C.

The APE was heated in an oil jacketed tank and filled into injection molded polypropylene (PP) containers. The fill temperature and container description are as follows:

TABLE 1

| Container # | 1 | 2 | 3 |
|---|---|---|---|
| Container Material | PP | PP | Impact polymer* |
| Container Type | Cylinder | Cylinder | Tray |
| Container Volume | 14 Cup | 48 Oz. | 350 $in^3$ |
| Container Thickness | 75 mil | 75 mil | 25–47 mil |

TABLE 1-continued

| APE Fill Temperature | 193° C. | 190° C. | 191° C. |
|---|---|---|---|
| | 4 | 5 | 6 |
| Container Material | PP | PP | Impact polymer* |
| Container Type | Cylinder | Cylinder | Tray |
| Container Volume | 14 Cup | 48 Oz. | 350 $in^3$ |
| Container Thickness | 75 mil | 75 mil | 25-47 mil |
| APE Fill Temperature | 205° C. | 205° C. | 205° C. |

*A blend of polypropylene and Kraton rubber.

The polypropylene materials typically have melting point temperatures of less than 163° C. The only container that melted after being filled was container #6. It is believed that the 205° C. fill temperature was too high for an impact polymer tray of this thickness (25-47 mil).

Example 2

Several injection molded polypropylene containers were filled with molten APE at various temperatures. Temperature measurements were taken at several locations. See Table 2 for filling conditions and the temperature difference across the filled containers. All containers used in this experiment were injection molded from a polypropylene homopolymer and had a wall thickness of approximately 75 mil.

Container #10 was filled with APE at 232° C. and did not melt. The temperature of the molten APE at the container wall was measured between 130° C. and 166° C., but the outside wall temperature was between 84° C. and 108° C. The temperature of the molten APE in the center of the container was measured at 210° C. twenty minutes after being filled. The melting point of the polypropylene material is believed to be approximately 160° C. Because of the dissipation of heat to the atmosphere, the outside surface of the polypropylene container never reached its melting point.

Example 3 (Comparative)

A container similar to containers #2 and 5was a 75 mil injection molded polypropylene container that was overfilled with APE at a fill temperature of 194° C. Molten APE ran down the outside of the container and the container melted. The lack of a large temperature difference across the container wall resulted in the failure of the PP container to hold the molten APE.

Example 4 (Comparative)

An injection molded container approximately 12" in diameter (I.D.), 4" tall, and 75 mil thick made from high density polyethylene (HDPE) with a melting point of approximately 130° C. was filled with molten APE at a fill temperature of 220° C. The molten APE melted the HDPE container.

Example 5

Several injection molded containers or buckets obtained from Texas Processed Plastics Inc. of Jacksonville, Texas made from a blend of linear low density polyethylene (LLDPE) and polypropylene (PP) were filled with molten amorphous polypropylene (APP). The APP had a viscosity at 190° C. of 2400 cP and a typical Cp of 0.68 calories/gram ° C. between 175° C. and 185° C.

The containers were 11 inches in diameter at the top, 12 inches tall with a wall thickness of 65 mil and a bottom thickness of 50 mil. These containers were filled four at a time with molten APP at a fill temperature of 194° C. at a rate of approximately 13lbs/minute/container while setting side by side on a pallet that holds 16 containers. The containers were set in 4 rows of 4 no closer than about 1 inch apart at the top and about 3 ½ inches at the bottom. After 16 containers were filled the containers were allowed to cool and another 16 containers were filled. There were 5 pallets of 16 filled containers. The filled containers were allowed to cool overnight (over about 20 hours) outside under ambient conditions (about 5° C.-10° C.). All of the containers held the molten APP without failing. The containers were then arranged on a pallet 18 containers per layer 4 layers high.

While the present invention has been described in detail, variations and modifications can be made without departing from the reasonable scope thereof.

I claim:

1. A process for packaging amorphous polyolefins comprising:

(a) supplying an amorphous polyolefin at a flowable temperature, (b) flowing said amorphous polyolefin into a molded polyolefin container having a wall thickness of at least 10 mils wherein the material of said container has a melting point below the temperature at which said amorphous polyolefin is flowed into the container, and (c) slowly cooling the filled container.

2. The process according to claim 1 wherein said amorphous polyolefin is flowed into said container at a temperature between about 150° C. and about 230° C. at a fill rate between about 1 and about 300 pounds per minute per container and is cooled at about 0.05° C. to about 0.45° C. per minute, based on the core temperature, down to a core temperature of about 100° C. or below.

3. The process according to claim 2 wherein said amorphous polyolefin is flowed into said container at a temperature between about 190° C. and about 200° C. at a fill rate between about 8 and about 20 pounds per minute per container.

4. The process according to claim 1 wherein the said flowable temperature is less than about y° C. wherein y=8.54 times the melting point of the container material in degrees celsius times the minimum wall thickness of the container in inches plus 143.

5. The process according to claim 1 wherein said container is cooled at essentially ambient conditions for about 8 to about 24 hours prior to significant contacting other filled containers.

6. The process according to claim 1 wherein said container is cooled by flowing water or air around the container at a temperature between about 0° C. to about 40° C.

7. The process according to claim 1 wherein said container material has a melting point no more than about 40° C. below the temperature at which the amorphous polyolefin is flowed into the container and said container has a $\Delta T$ across the container wall between about 0.5° C. to about 0.9° C. per mil at room temperature when filled.

8. The process according to claim 1 wherein said container has an internal diameter or internal width between about 4 inches and about 12 inches and a volume of about 1 to about 10 gal.

9. The process according to claim 1 wherein the wall thickness of said container is between about 10mils and about 150 mils.

10. The process according to claim 1 wherein said molded polyolefin container is made from polyolefins that are compatible with asphalt blends.

11. The process according to claim 10 wherein said molded polyolefin container is made from a polyolefin selected from the group consisting of polypropylene homopolymers, ethylene-propylene random copolymers, impact copolymers, filled polypropylenes and polypropylene blends.

12. The process according to claim 1 wherein said amorphous polyolefin is maintained at an elevated temperature in a heated vessel and flowed into a plurality of containers.

13. The process according to claim 12 wherein said vessel is a heated storage container and said amorphous polyolefin is heated during the polymerization reaction.

14. The process according to claim 1 wherein said amorphous polyolefin is normally soft and tacky at about room temperature, solidifies slowly, and has a low degree of crystallinity.

15. The process according to claim 14 wherein said amorphous polyolefin is amorphous polypropylene or amorphous propylene-ethylene copolymer having a RBSP between about 120° C. and about 160° C. and a Brookfield thermal viscosity between about 2,000 and about 20,000centipoise at 190° C.

16. An article of manufacture comprising a molded container of polyolefin containing a solid block of amorphous polyolefin essentially filling the void of the container wherein the polyolefin of said molded container has a melting point below the temperature at which said amorphous polyolefin is flowed into said container and said container has a wall thickness between about 30 mils and about 125 mils.

* * * * *